United States Patent [19]

Chichester et al.

[11] 4,062,269

[45] Dec. 13, 1977

[54] HYDRAULIC CYLINDER EXTENSION CONTROL

[75] Inventors: Willard L. Chichester; Donald A. Holtkamp, both of Battle Creek, Mich.

[73] Assignee: Clark Equipment Company, Buchanan, Mich.

[21] Appl. No.: 570,283

[22] Filed: Apr. 21, 1975

[51] Int. Cl.[2] ..... F15B 15/22

[52] U.S. Cl. ..... 91/400; 91/450; 91/459; 187/17; 318/481

[58] Field of Search ..... 91/1, 358 A, 35, 433, 91/451, 400, 450, 459, 468; 318/481, 663, 685; 187/17, 29 A

[56] References Cited

U.S. PATENT DOCUMENTS

| | | | |
|---|---|---|---|
| 2,331,108 | 10/1943 | De Ganahl | 91/358 A X |
| 2,665,122 | 1/1954 | Rowland | 184/6.18 X |
| 3,200,832 | 8/1965 | Adams | 137/117 |
| 3,583,220 | 6/1971 | Kawakami | 73/229 |
| 3,659,655 | 5/1972 | Gyongyosi | 91/1 X |
| 3,700,994 | 10/1972 | Gopfert | 318/663 X |
| 3,704,405 | 11/1972 | Miller, Jr. | 318/663 X |
| 3,727,520 | 4/1973 | McKnown | 318/685 X |
| 3,776,099 | 12/1973 | Knutson | 91/358 A |
| 3,782,248 | 1/1974 | Fuzzell | 91/358 A |
| 3,782,250 | 1/1974 | Kiszewski | 91/433 |
| 3,813,990 | 6/1974 | Coppola | 91/1 |

*Primary Examiner*—Martin P. Schwadron
*Assistant Examiner*—Abraham Hershkovitz
*Attorney, Agent, or Firm*—John C. Wiessler

[57] ABSTRACT

A hydraulic circuit for operator pre-selection in one exemplary embodiment of the extension of a lift truck upright which utilizes a fixed displacement hydraulic motor operating to adjust either a rotary switch or a potentiometer which is connected to a valve for interrupting the flow to the lift cylinder of the upright at the pre-selected height. The adjusted position of an operator's lift height selector is coordinated with the rotary switch or potentiometer or to effect the selected extension of the upright.

13 Claims, 4 Drawing Figures

HYDRAULIC CYLINDER EXTENSION CONTROL

BACKGROUND OF THE INVENTION

The field of art to which the invention pertains includes elevators, and more specifically portable elevators.

It has long been desirable to devise a simple, low cost and dependable means for the operator of a lift truck to be able to pre-select and precisely locate the lift fork or other attachment at the desired height, such as in elevated loading and unloading operations in, for example, product storage racks in warehouses and the like, without requiring special skill on the part of the operator.

Relatively complex and expensive systems have been heretofore proposed, but they have not been successful in any significant degree.

SUMMARY

It is a primary object of this invention to provide a relatively simple and inexpensive system for pre-selecting the extension or retraction of hydraulic cylinders. cl

DESCRIPTION OF THE PREFERRED EMBODIMENT

Figure 1:
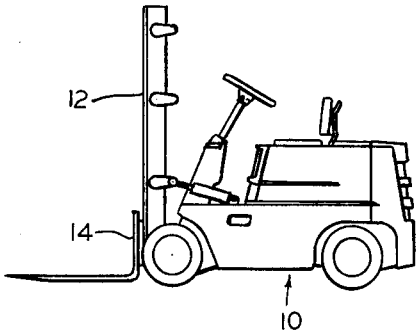
FIG. 1 is a side elevational view of a lift truck which incorporates the hydraulic system of the present invention.
Figure 2:
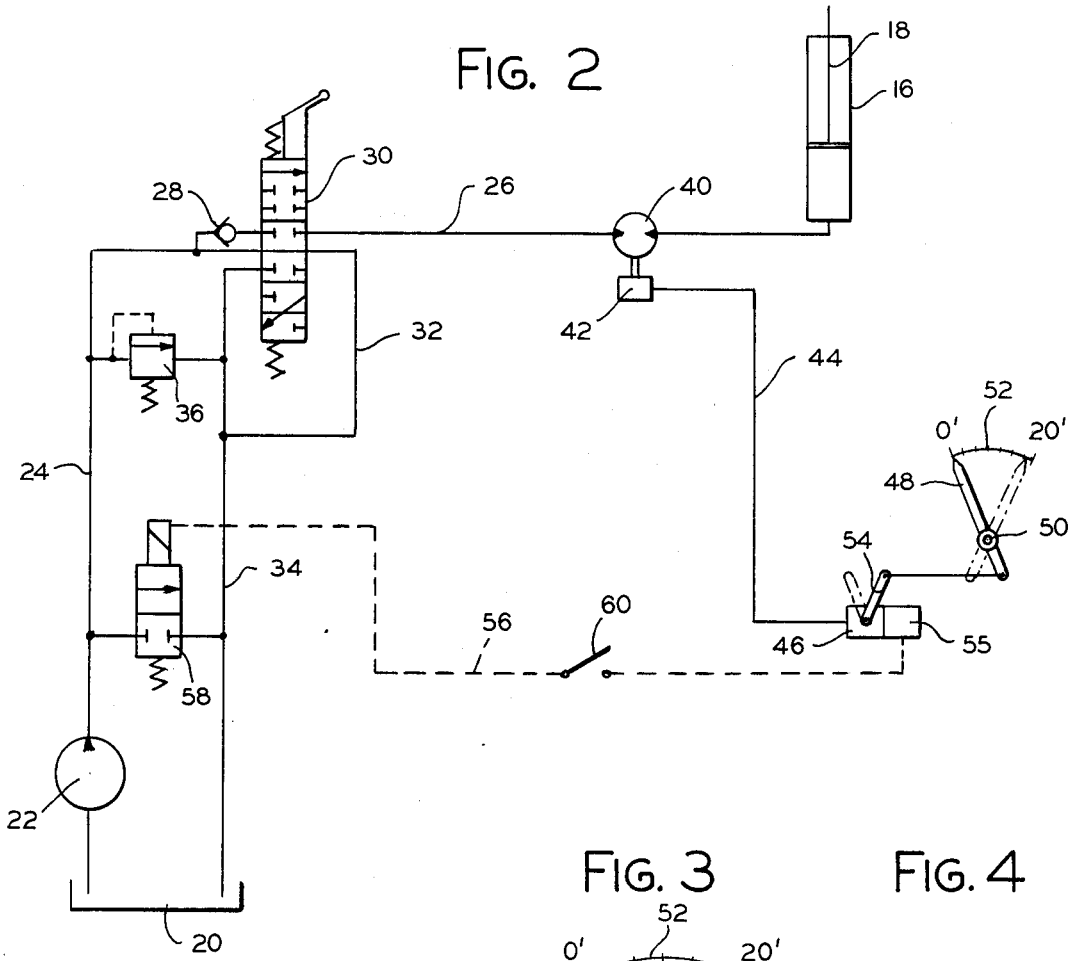
FIG. 2 is a schematic view of such a hydraulic system.

A lift truck 10 is shown having a conventional forwardly and rearwardly tiltable and telescopically elevatable upright 12 pivoted from the front drive axle of the truck. A fork and carriage 14 is elevatable on the mast by a conventional hydraulic lift cylinder and chain and sprocket means, the single-acting lift cylinder and piston rod assembly of which is shown at 16, 18.

The hydraulic system for actuating and controlling the lift cylinder assembly comprises a reservoir 20, a pump 22 connected to the reservoir and adapted to be connected to the base end of cylinder 16 by conduits 24 and 26 by way of a check valve 28 and a double-acting, open-center operator control valve assembly 30 of a well-known type. As shown, the valve is in a neutral "hold" position with the cylinder assembly maintained in a partially extended position as shown, and the continuously running engine driven pump 22 pumping through the open-center portion of the valve to the reservoir through conduits 24, 32 and 34. A pressure relief valve 36 is connected between conduits 24 and 34.

In order to accurately measure the pressure fluid entering the lift cylinder, a reversible fixed displacement hydraulic motor 40 is located in conduit 26. It is connected through a gear reducer 42 to drive a potentiometer 46 by a suitably connected linkage 44. An operator adjustable lever 48 pivots at 50 and may incorporate a scale 52 which is scaled to select precise elevations of the fork 14 from zero to twenty feet. Adjustment of lever 48 may be made to select any fork elevation in the available range; it is in turn connected to an adjustment lever 54 of the potentiometer so that selections of fork elevation and potentiometer setting are simultaneously effected by adjustment of lever 48. The potentiometer is connected to an amplifier 55 which is connected by lead line 56 to a normally closed solenoid valve 58 through a switch 60.

In operation, the system may be used in a conventional manner wherein the automatic lift height selection sub-system is inoperative simply by retaining switch 60 in an open position, whereby actuation of the potentiometer by gear reduction 42 is ineffective to actuate solenoid 58 open through the amplifier irrespective of the position of height selection lever 48.

If it is desired to automatically actuate the fork 14 and associated mechanism to a pre-selected elevation, the operator first moves selection lever 48 along scale 52 to the desired position, closes switch 60 for pre-select lift height operation, and actuates directional control valve 30, as is conventional, to extend the lift cylinder assembly and elevate the fork. During lifting operations, motor 40 drives gear reducer 42 which in turn drives potentiometer 46. When the potentiometer is adjusted to the selected lift height it will "null out", thereby causing amplifier 55 to actuate solenoid valve 58 to an open position which directs the fluid from pump 22 to the reservoir, thus stopping extension of the upright lift piston at the selected lift height for fork 14. It should be noted that the above operation is not affected by continuing to hold directional valve 30 open in a lift position inasmuch as check valve 28 interrupts any communication between the now relatively low and high pressure conduits 24 and 26, respectively.

Figure 3:
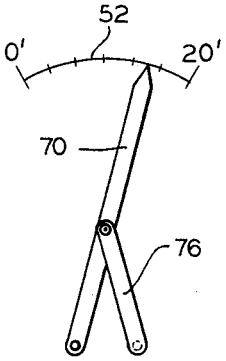
FIGS. 3 and 4 are front and side views of a rotary switch device which may be substituted.
Figure 4:
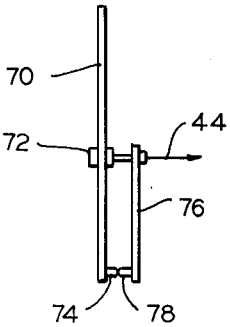

An alternative equivalent to the potentiometer and less costly component is shown as a rotary switch in FIGS. 3 and 4, by means of which a height selection lever 70, pivoted at 72 and having a contactor at 74, may be adjusted along scale 52. An arm 76 also pivots at 72, has a contactor at 78 which is connected to be continuously in circuit in the truck electrical system, and which is driven about pivot 72 by gear reducer 42 and linkage 44. At any given new selected height from zero to 20 feet, as illustrated, arm 76 is driven by motor 40 until contactors 74 and 78 make contact to open valve 58, as previously described.

It will be appreciated by persons skilled in the art that an extremely attractive feature of this invention is the unusual simplicity of the system to effect what has heretofore been a relatively complex matter. An important feature is in the use of two positive displacement hydraulic devices in series, viz., hydraulic motor 40 and the lift cylinder assembly, which permits an accurate measurement of the volume of hydraulic fluid flowing into the cylinder which in turn is an accurate measurement of the lift height. The pressure drop across motor 40 is substantially zero in such a system, so that there is substantially zero leakage in the motor which also contributes to the accuracy of lift height selection. The force required to drive the gear reducer 42 and the potentiometer or the rotary switch is negligible in such a system.

Although we have described and illustrated a preferred embodiment of our invention, it will be understood by those skilled in the art that modifications may be made in the structure, form and relative arrangement of parts without necessarily departing from the spirit and scope of the invention. It is clear also that numerous uses of the invention may be found other than in a lift truck upright, and, accordingly, it should be understood that we intend to cover by the appended claims all such modifications and uses which fall within the scope of our invention.

We claim:

1. In a lift truck having an extensible hydraulic lift cylinder for elevating extensible lift upright means to pre-slected elevations and hydraulic pump and valve means for actuating and controlling elevation of the upright means, means operative to pre-select and control automatically the distance of extension of the upright means including means for measuring the hydraulic fluid volume flowing to the lift cylinder during extension thereof, operator control means for selecting the desired extension of the upright means, means operative to interrupt the flow of hydraulic fluid to the lift cylinder at said desired upright extension irrespective of cylinder pressure, and circuit means operatively connected to said operator control means, to said fluid volume measuring means and to said interrupter means.

2. A lift truck as claimed in claim 1 wherein said circuit means includes a potentiometer means adjustable by said operator control means to select the desired extension of the upright means, and the operative connection of said fluid volume measuring means to the potentiometer means drives the latter means to null out at the selected extension.

3. A lift truck as claimed in claim 2 wherein said interrupter means comprises valve means activated to bypass the discharge of the hydraulic pump from the lift cylinder hydraulic circuit at the null position of the potentiometer means.

4. A lift truck as claimed in claim 1 wherein manual means is provided rendering inoperative the pre-select and automatic control means.

5. A lift truck as claimed in claim 2 wherein said fluid volume measuring means is a hydraulic motor having a mechanical operative connection to the potentiometer means.

6. A lift truck as claimed in claim 5 wherein said interrupter means comprises electric actuated valve means, a hydraulic fluid reservoir, said electric valve means being actuated to by-pass pump discharge to said reservoir at the selected extension of the upright means.

7. A lift truck as claimed in claim 1 wherein a fluid conduit connects the lift cylinder with the hydraulic pump and valve means, said fluid volume measuring means being located operatively in said conduit intermediate the valve means and lift cylinder.

8. A lift truck as claimed in claim 1 wherein said measuring means is a hydraulic motor, said interrupter means is a solenoid actuated valve means, and said circuit means is driven by said motor to close the circuit at the selected elevation of the upright means, at which elevation said solenoid valve means is actuated to interrupt fluid flow to said lift cylinder.

9. A lift truck as claimed in claim 1 wherein said circuit means including switch means adjustable by the operator control means to select the desired extension of the upright means, and the operative connection of said fluid volume measuring means to the circuit means drives an element of the switch means to close the circuit at the selected extension.

10. A control system for an extensible hydraulic cylinder means having hydraulic pump and valve means for actuating and controlling the extension of the cylinder means, comprising means operative to pre-select and control automatically the distance of extension of the cylinder means including means for measuring the hydraulic fluid volume flowing to the cylinder means during extension thereof, operator control means for selecting the desired extension of the cylinder means, means operative to interrupt the flow of hydraulic fluid to the cylinder means at said desired extension irrespective of cylinder pressure, and circuit means operatively connected to said operator control means, to said fluid volume measuring means and to said interrupter means.

11. A control system as claimed in claim 10 wherein said circuit means includes a potentiometer means adjustable by said operator control means to select the desired extension of the cylinder means, and the operative connection of said fluid volume measuring means to the potentiometer means drives the latter means to null out at the selected extension.

12. A control system as claimed in claim 11 wherein said interrupter means comprises valve means activated to bypass the discharge of the hydraulic pump from the hydraulic circuit of the cylinder means at the null position of the potentiometer means.

13. A control system as claimed in claim 10 wherein said measuring means is a hydraulic motor, said interrupter means is a solenoid actuated valve means, and said circuit means is driven by said motor to close the circuit at the selected extension of the cylinder means, at which extension said solenoid valve means is actuated to interrupt fluid flow to said cylinder means.

* * * * *